US012280304B1

(12) United States Patent
Huang

(10) Patent No.: US 12,280,304 B1
(45) Date of Patent: Apr. 22, 2025

(54) VOLLEYBALL TRAINING DEVICE

(71) Applicant: Shenzhen Paqi Technology Co., Ltd., Shenzhen (CN)

(72) Inventor: Junhui Huang, Guangdong (CN)

( * ) Notice: Subject to any disclaimer, the term of this patent is extended or adjusted under 35 U.S.C. 154(b) by 0 days.

(21) Appl. No.: 18/779,446

(22) Filed: Jul. 22, 2024

(51) Int. Cl.

| | |
|---|---|
| ***A63B 61/02*** | (2006.01) |
| ***A63B 61/00*** | (2006.01) |
| ***A63B 61/04*** | (2006.01) |
| ***A63B 69/00*** | (2006.01) |

(52) U.S. Cl.
CPC ..... *A63B 69/0095* (2013.01); *A63B 61/006* (2013.01); *A63B 61/02* (2013.01); *A63B 61/04* (2013.01); *A63B 2243/0095* (2013.01)

(58) Field of Classification Search
CPC ... A63B 69/0095; A63B 61/006; A63B 61/02; A63B 61/04; A63B 61/003; A63B 2243/0095; A63B 71/028; A63B 71/023
See application file for complete search history.

(56) References Cited

U.S. PATENT DOCUMENTS

| | | | | | |
|---|---|---|---|---|---|
| 4,274,632 | A * | 6/1981 | Jacobs | A63B 61/02 | 473/492 |
| 5,156,408 | A * | 10/1992 | Hall | A63B 61/02 | 473/492 |
| 5,470,056 | A * | 11/1995 | Dennesen | A63B 69/0095 | 473/462 |
| 5,472,212 | A * | 12/1995 | Bercaw | A63B 69/0095 | 473/462 |
| 6,929,570 | B2 * | 8/2005 | Forman, III | A63B 69/0095 | 473/476 |
| 7,056,241 | B1 * | 6/2006 | Ishino | A63B 69/0095 | 473/473 |
| 11,278,785 | B1 * | 3/2022 | Wiesolek | A63B 69/0071 | |
| 11,826,623 | B2 * | 11/2023 | Burns, III | A63B 61/02 | |
| 2011/0230284 | A1 * | 9/2011 | Simon | A63B 61/02 | 248/188.7 |
| 2015/0057109 | A1 * | 2/2015 | Chen | A63B 69/0002 | 473/416 |
| 2016/0361616 | A1 * | 12/2016 | Downing | A63B 69/0095 | |
| 2017/0106266 | A1 * | 4/2017 | Nelson | A63B 69/002 | |
| 2018/0185727 | A1 * | 7/2018 | Nelson | A63B 71/022 | |
| 2022/0401806 | A1 * | 12/2022 | Sirover | A63B 61/006 | |
| 2023/0191218 | A1 * | 6/2023 | Alvarez | A63B 67/06 | 273/400 |

* cited by examiner

*Primary Examiner* — John E Simms, Jr.

(57) ABSTRACT

A volleyball training device has a training state and a using state, including a base, a volleyball net component, and an interception net component. The volleyball net component and the interception net component are detachably connected to the base. In the using state, the volleyball net component is connected to the base, and the interception net component is detached from the base. In the training state, the volleyball net component is connected to the base, and the interception net component is connected to the base. Through the structure above, when in the training state, the interception net component can intercept the volleyball that passes an upper end of the volleyball net component, facilitating a user's practice of volleyball actions such as serving and spiking. When in the using state, only the volleyball net component is connected to the base, and the user can normally hit the volleyball.

19 Claims, 13 Drawing Sheets

VOLLEYBALL TRAINING DEVICE

TECHNICAL FIELD

The present invention relates to the technical field of volleyball equipment, in particular to a volleyball training device.

BACKGROUND ART

Volleyball, as a ball sport, can effectively exercise the muscles of the human body, enhance cardiopulmonary function, and promote flexibility and coordination of the body. In volleyball sport, people often need to use volleyball nets and volleyball training nets.

At present, most of the existing volleyball training nets on the market have relatively single functions. There are usually volleyball nets and interception nets, which are fixedly connected to an identical base. However, such products can only be used during volleyball training, especially during single player training such as serving and spiking, and cannot be used as separate volleyball nets for multiple people, thus the utilization rate of the products is very low. Moreover, when people need to participate in volleyball matches, the volleyball training nets need to be separated, which is inconvenient to use.

Therefore, a volleyball training device is provided in the present invention, which can effectively solve the above problems. The volleyball training device has a simple structure, convenient use, rich functions and high product utilization rate.

SUMMARY

In order to overcome the shortcomings of the prior art, a volleyball training device is provided in the present invention, which has simple structure, convenient use, rich functions and high product utilization rate.

The technical solution adopted by the present invention to solve its technical problems is as follows.

A volleyball training device has a training state and a using state. The volleyball training device includes a base, a volleyball net component, and an interception net component. The volleyball net component is detachably connected to the base. The interception net component is detachably connected to the base.

When in the using state, the volleyball net component is connected to the base, and the interception net component is detached from the base. When in the training state, the volleyball net component is connected to the base, and the interception net component is connected to the base.

As an improvement of the present invention, the base includes two installation seats. Both ends of the volleyball net component and both ends of the interception net component are respectively detachably connected to the two installation seats. When in the using state, the volleyball net component is connected to a middle portion of the installation seat, and the interception net component is detached from the installation seat. When in the training state, the volleyball net component is connected to a front portion of the installation seat, and the interception net component is connected to a rear portion of the installation seat.

As an improvement of the present invention, the volleyball net component includes a net and a net supporting rod. The net is connected to the net supporting rod through a net connecting member, and a lower end of the net supporting rod is connected to the installation seat.

As an improvement of the present invention, the interception net component includes an interception net, a supporting rod of interception net and a pull belt. Both sides of the interception net are connected with the supporting rod of interception net through a connecting sleeve of interception net, and an upper end of the interception net is provided with the pull belt. A lower end of the supporting rod of interception net is connected to the rear portion of the installation seat, the pull belt is connected to the front portion of the installation seat, and the upper portion of the interception net is bent forward under the action of the pull belt.

As an improvement of the present invention, the interception net component also includes a collection net and a cylindrical collection net. One side of the collection net is connected to a lower edge of the interception net, and an opposite side of the collection net is connected to a middle portion of the pull belt. The collection net is provided with a ball outlet hole. The cylindrical collection net extends downward along an edge of the ball outlet hole. The collection net is low in a middle portion and high at an edge, and the ball outlet hole is arranged in the middle portion of the collection net.

As an improvement of the present invention, the interception net component also includes a front net and two side nets, a lower edge of the front net is connected to an edge of the collection net and extends upward, a side edge of the front net is connected to the pull belt, a lower edge of the side net is connected to a side edge of the collection net and extends upward, and a side edge of the side net is connected to the pull belt and a side edge of the interception net.

As an improvement of the present invention, an upper edge of the interception net is higher than an upper edge of the volleyball net component. The upper edge of the volleyball net component is higher than an upper edge of the front net. A ball intercepting space with a front side opening is formed between the front net, the two side nets, and the interception net.

As an improvement of the present invention, the installation seat includes two first connecting members, and the two first connecting members are detachably connected to both ends of the installation seat. When in the training state, the volleyball net component is connected to one of the first connecting members, and the interception net component is connected to another of the first connecting members.

As an improvement of the present invention, the installation seat is provided with a fourth connecting member. When in the using state, the volleyball net component is connected to the fourth connecting member, and the two first connecting members are detached from both ends of the installation seat.

As an improvement of the present invention, the installation seat includes a second connecting member and a third connecting member. The second connecting member is connected to a first end of the installation seat, and the third connecting member is connected to a second end of the installation seat or the middle portion of the installation seat. When in the using state, the second connecting member is detached from the first end of the installation seat, the third connecting member is connected to the middle portion of the installation seat, and the volleyball net component is connected to the third connecting member. When in the training state, the second connecting member is connected to the first end of the installation seat, and the third connecting member is connected to the second end of the installation seat. The volleyball net component is connected to the third connecting member, and the interception net component is connected to the second connecting member.

As an improvement of the present invention, the first connecting member is provided with a first insertion part and a first reinforcement part extending from both sides of the first insertion part. The fourth connecting member is provided with a fourth insertion part and a fourth reinforcement part extending from both sides of the fourth insertion part. The lower end of the net supporting rod is detachably inserted into the fourth insertion part or one first insertion part, and the lower end of the supporting rod of interception net is detachably inserted into another first insertion part.

As an improvement of the present invention, the second connecting member is provided with a second insertion part and a second reinforcement part extending from both sides of the second insertion part. The third connecting member is provided with a third insertion part and a third reinforcement part extending from both sides of the third insertion part. A lower end of the net supporting rod is detachably inserted into the third insertion part, and the lower end of the supporting rod of interception net is detachably inserted into the second insertion part.

As an improvement of the present invention, the base also includes a first connecting rod, and both ends of the first connecting rod are respectively connected to the middle portions of the two installation seats.

As an improvement of the present invention, the base also includes a second connecting rod, and both ends of the second connecting rod are respectively connected to two third connecting members.

As an improvement of the present invention, the first connecting rod includes a plurality of first connecting rod units, and two adjacent first connecting rod units are successively connected end to end.

As an improvement of the present invention, the second connecting rod includes a plurality of second connecting rod units, and two adjacent second connecting rod units are successively connected end to end.

As an improvement of the present invention, the volleyball training device also includes a first locking member, and the first locking member fixes the first connecting member to the installation seat.

As an improvement of the present invention, the volleyball training device also includes a second locking member, and the second locking member fixes the third connecting member and the fourth connecting member to the installation seat.

As an improvement of the present invention, the first connecting member is provided with a first connecting ring. When in the training state, the interception net component is connected to one of the first connecting members, and the pull belt is connected to the first connecting ring on another of the first connecting members.

As an improvement of the present invention, the third connecting member is provided with a second connecting ring. When in the training state, the interception net component is connected to the second connecting member, and the pull belt is connected to the second connecting ring on the third connecting member.

The beneficial effects of the present invention are as follows. Through the arrangement of the above structure, during the single player volleyball training, the volleyball net component is connected to the base, and the interception net component is connected to the base. At this time, the volleyball training device is in the training state, and the interception net component can intercept the volleyball that passes the upper end of the volleyball net component, making it convenient for a user to practice volleyball actions such as serving and spiking. During a volleyball match or a multi-person battle, the interception net component is detached from the base, and the volleyball net component is connected to the base. At this time, the volleyball training device is in the using state, only the volleyball net component is connected to the base, and the user can normally hit the volleyball to make the volleyball cross the upper end of the volleyball net component. The product has a variety of functions, the utilization rate is significantly improved, making it convenient for the user to use.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
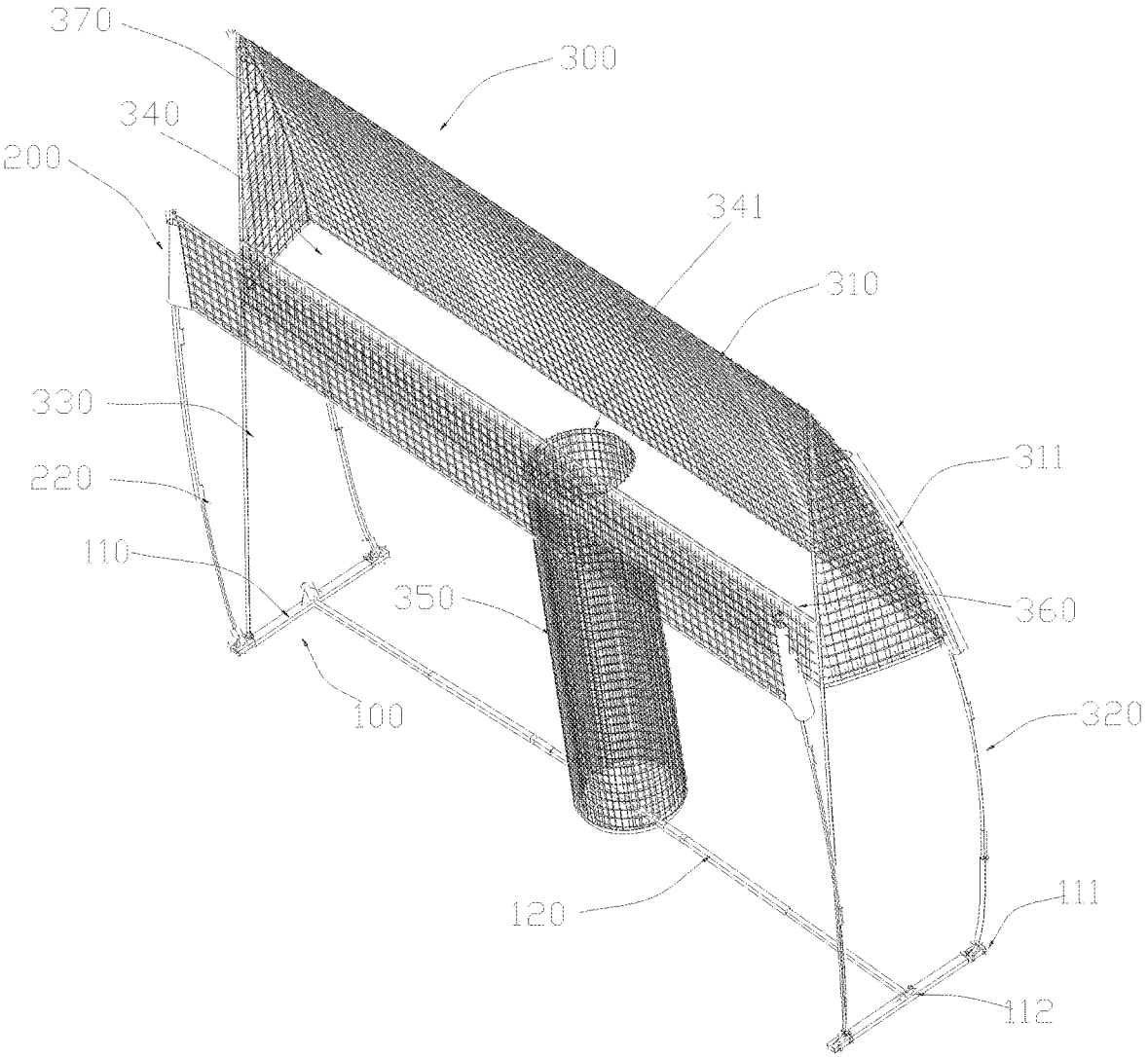
FIG. 1 is a schematic diagram of an overall structure from an angle of view in embodiment one of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Embodiment One

FIGS. 1-6 show a volleyball training device. The volleyball training device has a training state and a using state. The volleyball training device includes a base 100, a volleyball net component 200, and an interception net component 300. The volleyball net component 200 is detachably connected to the base 100. The interception net component 300 is detachably connected to the base 100.

When in the using state, the volleyball net component 200 is connected to the base 100, and the interception net component 300 is detached from the base 100. When in the training state, the volleyball net component 200 is connected to the base 100, and the interception net component 300 is connected to the base 100.

Figure 2:
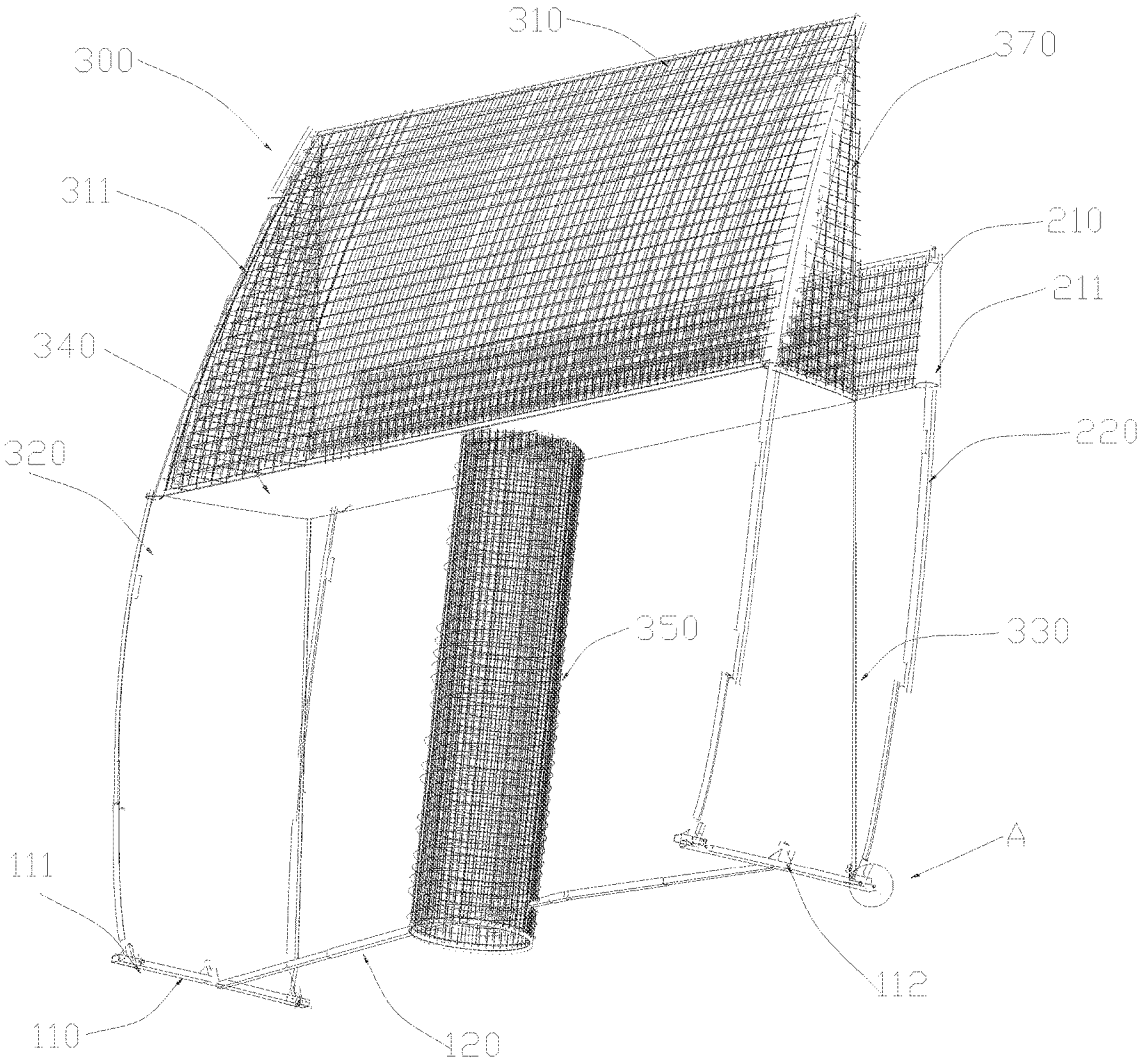
FIG. 2 is a schematic diagram of an overall structure from another angle of view in embodiment one of the present invention.
Figure 4:
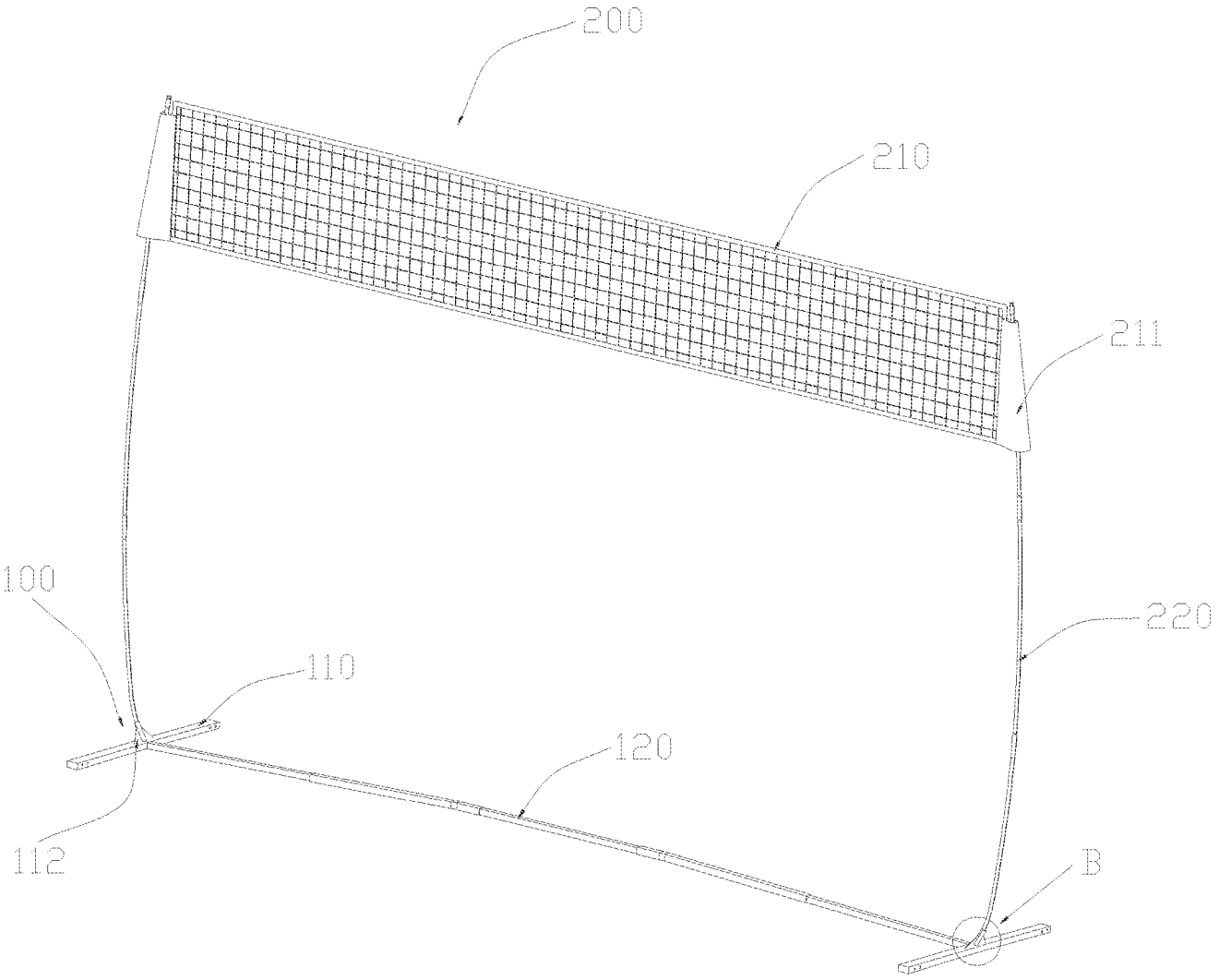
FIG. 4 is a structural diagram of embodiment one of the present invention when in a using state.

Through the arrangement of the above structure, during the single player volleyball training, the volleyball net component 200 is connected to the base 100, and the interception net component 300 is connected to the base 100, as shown in FIGS. 1-2. At this time, the volleyball training device is in the training state, and the interception net component 300 can intercept the volleyball that passes an upper end of the volleyball net component 200, making it convenient for a user to practice volleyball actions such as serving and spiking. During a volleyball match or a multi-person battle, the interception net component 300 is detached from the base 100, and only the volleyball net component 200 is connected to the base 100, as shown in FIG. 4. At this time, the volleyball training device is in the using state, only the volleyball net component 200 is connected to the base 100, and the user can normally hit the volleyball to make the volleyball cross the upper end of the volleyball net component 200. The product has a variety of functions, the utilization rate is significantly improved, making it convenient for the user to use.

In this embodiment, the base 100 includes two installation seats 110. Both ends of the volleyball net component 200 and both ends of the interception net component 300 are respectively detachably connected to the two installation seats 110. When in the using state, the volleyball net component 200 is connected to a middle portion of the installation seat 110, and the interception net component 300 is detached from the installation seat 110. When in the training state, the volleyball net component 200 is connected to a front portion of the installation seat 110, and the interception net component 300 is connected to a rear portion of the installation seat 110. Through the configuration of the above structure, when the volleyball training device is in the using state, the interception net component 300 is separated from the installation seat 110, the volleyball net component 200 is connected to the middle portion of the installation seat 110, and a front end and a back end of the installation seat 110 are respectively positioned on a front side and a back side of the volleyball net component 200, as shown in FIG. 4. The center of gravity of the whole product is stable, and the product has strong stability and is not easy to tip over, making the user experience better. When the volleyball training device is in the training state, the volleyball net component 200 and the interception net component 300 are connected to the front portion and the rear portion of the installation seat 110 respectively, as shown in FIGS. 1-2, so that the front portion and the rear portion of the installation seat 110 bear roughly the same force, the center of gravity of the product is stable, the product is not easy to tip over, and the user has a better experience.

In this embodiment, the volleyball net component 200 includes a net 210 and a net supporting rod 220. The net 210 is connected to the net supporting rod 220 through a net connecting member 211, and a lower end of the net supporting rod 220 is connected to the installation seat 110. Through the configuration of the above structure, when in use, the net supporting rod 220 is connected with the net connecting member 211, which can achieve the connection between the net 210 and the net supporting rod 220, and the lower end of the net supporting rod 220 is directly connected to the installation seat 110, making it convenient for the product to be assembled. Preferably, the net connecting member 211 is a connecting sleeve, and the connection can be achieved by simply inserting the net supporting rod 220 into the connecting sleeve when the product is assembled.

In this embodiment, the interception net component 300 includes an interception net 310, a supporting rod 320 of interception net and a pull belt 330. Both sides of the interception net 310 are connected with the supporting rod 320 of interception net through a connecting sleeve 311 of interception net, and an upper end of the interception net is provided with the pull belt 330. Alower end of the supporting rod 320 of interception net is connected to the rear portion of the installation seat 110, the pull belt 330 is connected to the front portion of the installation seat 110, and the upper portion of the interception net 310 is bent forward under the action of the pull belt 330. Through the arrangement of the above structure, by inserting the supporting rod 320 of interception net into the connecting sleeve 311 of interception net, the connection between the interception net 310 and the supporting rod 320 of interception net can be achieved. At the same time, the lower end of the supporting rod 320 of interception net is connected to the rear portion of the installation seat 110, the pull belt 330 is connected to the front portion of the installation seat 110, and the upper portion of the interception net 310 and part of the supporting rod 320 of interception net are bent forward, as shown in FIG. 1. At this time, the volleyball training device is in the training state. The forward bent interception net 310 can effectively intercept the volleyball, and prevent the volleyball that hits the interception net 310 from rolling upward along the interception net 310 and passing over the upper portion of the interception net 310, thereby improving the efficiency of intercepting volleyball with the interception net 310.

In this embodiment, the interception net component 300 also includes a collection net 340 and a cylindrical collection net 350. One side of the collection net 340 is connected to a lower edge of the interception net 310, and an opposite side of the collection net 340 is connected to a middle portion of the pull belt 330. The collection net 340 is provided with a ball outlet hole 341. The cylindrical collection net 350 extends downward along an edge of the ball outlet hole 341. The collection net 340 is low in a middle portion and high at an edge, and the ball outlet hole 341 is arranged in the middle portion of the collection net 340. Through the arrangement of the above structure, when in use, the volleyball intercepted by the interception net 310 falls down to the collection net 340, rolls along a surface of the collection net 340, and finally passes through the ball outlet hole 341 and falls into the cylindrical collection net 350, thereby effectively storing the volleyball and facilitating the user to retrieve and use the volleyball. In addition, the middle portion of the collection net 340 is low and the edge of the collection net 340 is high, which makes the volleyball roll towards the ball outlet hole 341 in the middle portion of the collection net 340 under the action of gravity, thereby improving the efficiency of the volleyball entering the cylindrical collection net 350.

In this embodiment, the interception net component 300 also includes a front net 360 and two side nets 370. A lower edge of the front net 360 is connected to an edge of the collection net 340 and extends upward. A side edge of the front net 360 is connected to the pull belt 330. A lower edge of the side net 370 is connected to a side edge of the collection net 340 and extends upward. A side edge of the side net 370 is connected to the pull belt 330 and a side edge of the interception net 310. Through the arrangement of the above structure, the front net 360 can intercept the volleyball that rebounds after hitting the interception net 310, preventing the volleyball from falling directly along a front edge of the collection net 340, and the two side nets can prevent the volleyball from falling along two side edges of the collection net 340, improving the efficiency of the volleyball return and storage, so that the user does not need to pick up the ball around, thereby improving the training efficiency and user experience of using the volleyball training device.

In this embodiment, an upper edge of the interception net 310 is higher than an upper edge of the volleyball net component 200, and the upper edge of the volleyball net component 200 is higher than an upper edge of the front net 360. A ball intercepting space with a front side opening is formed between the front net 360, the two side nets 370, and the interception net 310. Through the arrangement of the above structure, the upper edge of the interception net 310 is higher than the upper edge of the volleyball net component 200, which can effectively intercept the volleyball passing the upper edge of the volleyball net component 200, and facilitate the interception and storage of the volleyball. The upper edge of the front net 360 is lower than the volleyball net component 200, which allows the volleyball to pass the upper edge of the volleyball net component 200, and also enables the volleyball that rebounds after hitting the interception net 310 to be intercepted. The ball intercepting space can effectively intercept and store the volleyball.

In this embodiment, the installation seat 110 includes two first connecting members 111, and the two first connecting members 111 are detachably connected to both ends of the installation seat 110. When in the training state, the volleyball net component 200 is connected to one of the first connecting members 111, and the interception net component 300 is connected to another of the first connecting members 111. Referring to FIGS. 1-2, the two first connecting members 111 are connected to both ends of the installation seat 110, the volleyball net component 200 is connected to the first connecting member 111 at the front portion of the installation seat 110, and the interception net component 300 is connected to the first connecting member 111 at the rear portion of the installation seat 110. At this time, the product is in the training state. The volleyball net component 200 and the interception net component 300 are arranged at intervals from front to back, so that the center of gravity of the product is more stable and the product is less likely to tip over.

In this embodiment, the installation seat 110 is provided with a fourth connecting member 112. When in the using state, the volleyball net component 200 is connected to the fourth connecting member 112, and the two first connecting members 111 are detached from both ends of the installation seat 110. Referring to FIG. 4, the fourth connecting member 112 is arranged in the middle portion of the installation seat 110, the two first connecting members 111 are detached from both ends of the installation seat 110, and the volleyball net component 200 is connected to the fourth connecting member 112. At this time, the product is in the using state, and both the front and rear sides of the volleyball net component 200 are partially protruding from the plane where the volleyball net component 200 is positioned, making the support of the product more stable and the product not easy to tip over when the volleyball net component 200 is impacted by the volleyball.

Figure 5:
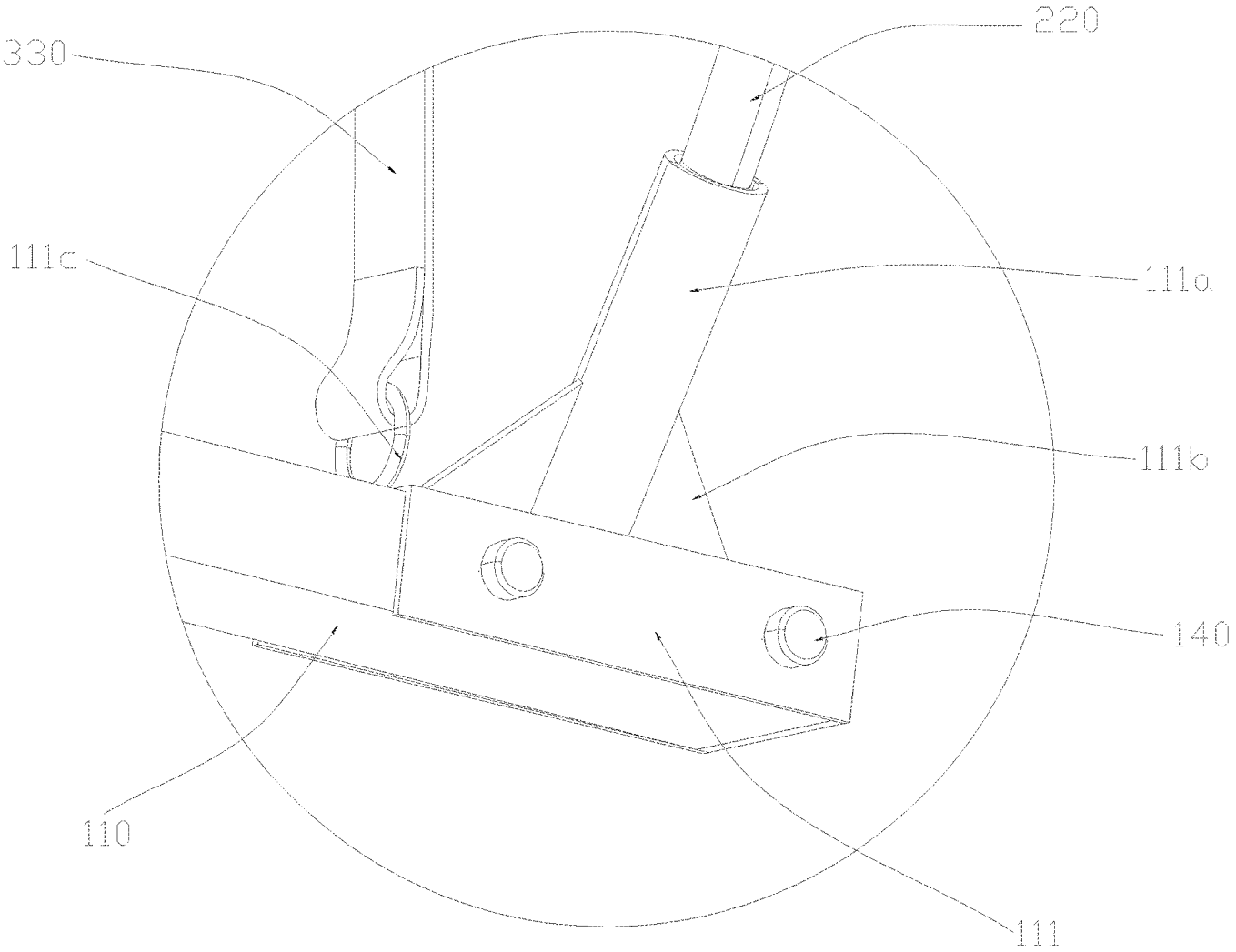
FIG. 5 is an enlarged view at circle A in FIG. 2.
Figure 6:
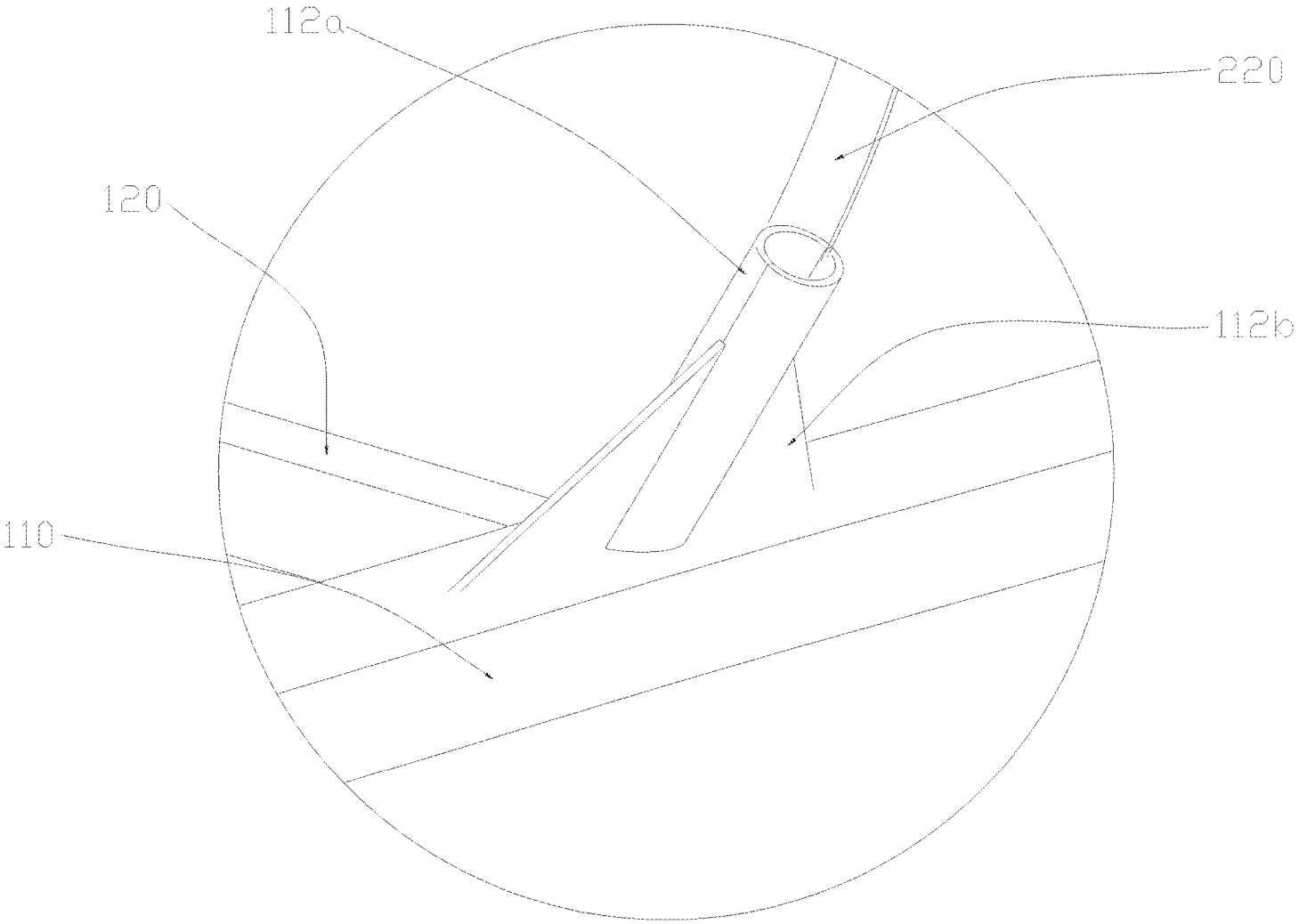
FIG. 6 is an enlarged view at circle B in FIG. 4.

In this embodiment, the first connecting member 111 is provided with a first insertion part 111*a* and a first reinforcement part 111*b* extending from both sides of the first insertion part 111*a*. The fourth connecting member 112 is provided with a fourth insertion part 112*a* and a fourth reinforcement part 112*b* extending from both sides of the fourth insertion part 112*a*. The lower end of the net supporting rod 220 is detachably inserted into the fourth insertion part 112*a* or one first insertion part 111*a*, and the lower end of the supporting rod 320 of interception net is detachably inserted into another first insertion part 111*a*. Referring to FIGS. 5-6, when in the training state, the two first connecting members 111 are connected to both ends of the installation seat 110, the lower end of the net supporting rod 220 is inserted into the first insertion part 111*a* on the first connecting member 111 at the front portion of the installation seat 110, the lower end of the supporting rod 320 of interception net is inserted into the first insertion part 111*a* on the first connecting member 111 at the rear portion of the installation seat 110, and the first reinforcement part 111*b* can strengthen the connection strength between the first insertion part 111*a* and a main body of the first connecting member 111. When in the using state, the two first connecting members 111 are separated from both ends of the installation seat 110, the lower end of the net supporting rod 220 is inserted into the fourth insertion part 112*a* to facilitate connection, and the fourth reinforcement part 112*b* can improve the connection strength between the fourth insertion part 112*a* and the installation seat 110. Preferably, the first insertion part 111*a* and the fourth insertion part 112*a* are both inclined upwards and to the left and right sides relative to an upper surface of the installation seat 110. When the net supporting rod 220 is inserted into the first insertion part 111*a* or the fourth insertion part 112*a*, and the supporting rod 320 of interception net is inserted into the first insertion part 111*a*, the net supporting rod 220 and the supporting rod 320 of interception net bend in an arc shape, elastic restoring forces of the net supporting rod 220 and the supporting rod 320 of interception net drive both sides of the net 210 and both sides of the interception net 310 to move outward, and the net 210 and the interception net 310 are tautened to avoid sagging in a middle portion of the net 210 and a middle portion of the interception net 310, thereby improving the use effect of the product.

In the present embodiment, the base 100 also includes a first connecting rod 120, and both ends of the first connecting rod 120 are respectively connected to the middle portions of the two installation seats 110. Referring to FIGS. 1-2 and FIG. 4, the two ends of the first connecting rod 120 are respectively connected to the middle portions of the two installation seats 110, which can limit the distance between the middle portions of the two installation seats 110, so as to ensure the strength and stability of the base 100. Preferably, the first connecting rod 120 is in the shape of an arch bridge with a high middle and two low sides, making the connection between the first connecting rod 120 and the two installation seats 110 more stable, and preventing the elastic restoring forces of the net supporting rod 220 and the supporting rod 320 of interception net from driving the installation seat 110 to rotate to ensure the stability of the overall structure of the product.

Figure 3:
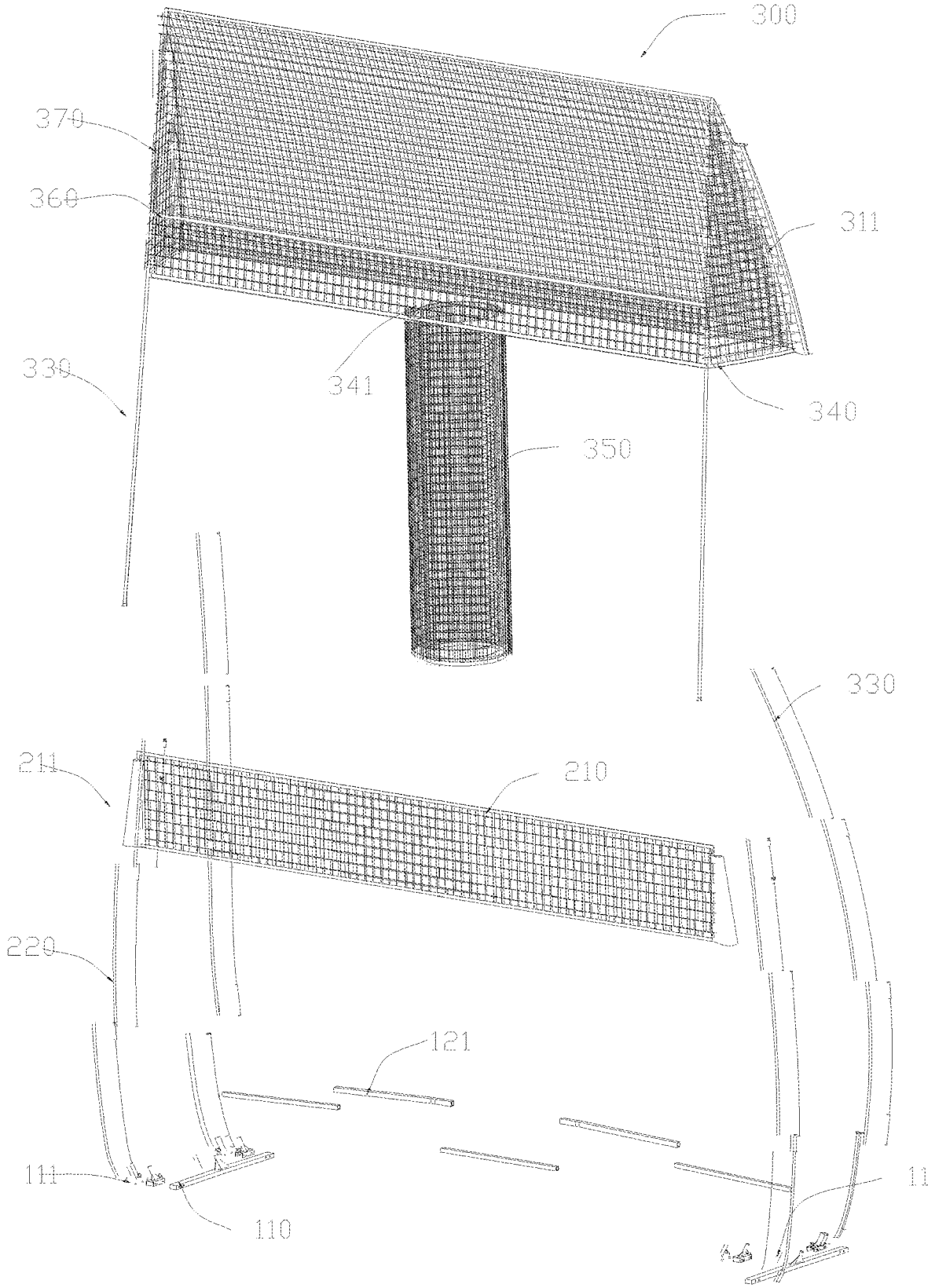
FIG. 3 is a schematic diagram of an exploded structure in embodiment one of the present invention.

In this embodiment, the first connecting rod 120 includes a plurality of first connecting rod units 121, and two adjacent first connecting rod units 121 are successively connected end to end. Referring to FIG. 3, the plurality of first connecting rod units 121 are connected end to end to form the first connecting rod 120, which can reduce a length of the product during the storage and transportation process, thus reducing a volume of the package and facilitating the user to carry.

In this embodiment, the volleyball training device also includes a first locking member 140, and the first locking member 140 fixes the first connecting member 111 to the installation seat 110. Referring to FIGS. 5-6, the first connecting member 111 can be fixed on the installation seat 110 by using the first locking member 140, so that the use is convenient, and the connection is fixed more stably to make the product stronger.

In this embodiment, the first connecting member 111 is provided with a first connecting ring 111*c*. When in the training state, the interception net component 300 is connected to one of the first connecting members 111, and the pull belt 330 is connected to the first connecting ring 111*c* on another of the first connecting members 111. Referring to FIGS. 1-2 and FIG. 5, when in the training state, the two first connecting members 111 are connected to both ends of the installation seat 110, the lower end of the supporting rod 320 of interception net is inserted into the first insertion part 111*a* on the first connecting member 111 at the rear portion of the installation seat 110, and the pull belt 330 is connected to the first connecting ring 111*c* on the first connecting member 111 at the front portion of the installation seat 110, so that the interception net component 300 can be stably connected, and the upper portion of the interception net 310 and part of the supporting rod 320 of interception net can be bent forward to intercept the volleyball.

Embodiment Two

FIGS. 7-13 show a volleyball training device. The volleyball training device has a training state and a using state. The volleyball training device includes a base 100, a volleyball net component 200, and an interception net component 300. The volleyball net component 200 is detachably connected to the base 100. The interception net component 300 is detachably connected to the base 100.

When in the using state, the volleyball net component 200 is connected to the base 100, and the interception net component 300 is detached from the base 100. When in the training state, the volleyball net component 200 is connected to the base 100, and the interception net component 300 is connected to the base 100.

Through the arrangement of the above structure, during the single player volleyball training, the volleyball net component 200 is connected to the base 100, and the interception net component 300 is connected to the base 100, as shown in FIGS. 1-2. At this time, the volleyball training device is in the training state, and the interception net component 300 can intercept the volleyball that passes an upper end of the volleyball net component 200, making it convenient for a user to practice volleyball actions such as serving and spiking. During a volleyball match or a multi-person battle, the interception net component 300 is detached from the base 100, and the volleyball net component 200 is connected to the base 100, as shown in FIG. 4. At this time, the volleyball training device is in the using state, only the volleyball net component 200 is connected to the base 100, and the user can normally hit the volleyball to make the volleyball cross the upper end of the volleyball net component 200. The product has a variety of functions, the utilization rate is significantly improved, making it convenient for the user to use.

In this embodiment, the base 100 includes two installation seats 110. Both ends of the volleyball net component 200 and both ends of the interception net component 300 are respectively detachably connected to the two installation seats 110. When in the using state, the volleyball net component 200 is connected to a middle portion of the installation seat 110, and the interception net component 300 is detached from the installation seat 110. When in the training state, the volleyball net component 200 is connected to a front portion of the installation seat 110, and the interception net component 300 is connected to a rear portion of the installation seat 110. Through the configuration of the above structure, when the volleyball training device is in the using state, the interception net component 300 is separated from the installation seat 110, the volleyball net component 200 is connected to the middle portion of the installation seat 110, and a front end and a back end of the installation seat 110 are respectively positioned on a front side and a back side of the volleyball net component 200, as shown in FIG. 4. The center of gravity of the whole product is stable, the product has strong stability and is not easy to tip over, making the user experience better. When the volleyball training device is in the training state, the volleyball net component 200 and the interception net component 300 are connected to the front portion and the rear portion of the installation seat 110 respectively, as shown in FIGS. 1-2, so that the front portion and the rear portion of the installation seat 110 bear roughly the same force, the center of gravity of the product is stable, the product is not easy to tip over, and the user has a better experience.

In this embodiment, the volleyball net component 200 includes a net 210 and a net supporting rod 220. The net 210 is connected to the net supporting rod 220 through a net connecting member 211, and a lower end of the net supporting rod 220 is connected to the installation seat 110. Through the configuration of the above structure, when in use, the net supporting rod 220 is connected with the net connecting member 211, which can achieve the connection between the net 210 and the net supporting rod 220, and the lower end of the net supporting rod 220 is directly connected to the installation seat 110, making it convenient for the product to be assembled. Preferably, the net connecting member 211 is a connecting sleeve, and the connection can be achieved by simply inserting the net supporting rod 220 into the connecting sleeve when the product is assembled.

In this embodiment, the interception net component 300 includes an interception net 310, a supporting rod 320 of interception net and a pull belt 330. Both sides of the interception net 310 are connected with the supporting rod 320 of interception net through a connecting sleeve 311 of interception net, and an upper end of the interception net is provided with the pull belt 330. Alower end of the supporting rod 320 of interception net is connected to the rear portion of the installation seat 110, the pull belt 330 is connected to the front portion of the installation seat 110, and the upper portion of the interception net 310 is bent forward under the action of the pull belt 330. Through the arrangement of the above structure, by inserting the supporting rod 320 of interception net into the connecting sleeve 311 of interception net, the connection between the interception net 310 and the supporting rod 320 of interception net can be achieved. At the same time, the lower end of the supporting rod 320 of interception net is connected to the rear portion of the installation seat 110, the pull belt 330 is connected to the front portion of the installation seat 110, and the upper portion of the interception net 310 and part of the supporting rod 320 of interception net are bent forward, as shown in FIG. 1. At this time, the volleyball training device is in the training state. The forward bent interception net 310 can effectively intercept the volleyball, and prevent the volleyball that hits the interception net 310 from rolling upward along the interception net 310 and passing over the upper portion of the interception net 310, thereby improving the efficiency of intercepting volleyball with the interception net 310.

In this embodiment, the interception net component 300 also includes a collection net 340 and a cylindrical collection net 350, one side of the collection net 340 is connected to a lower edge of the interception net 310, and an opposite side of the collection net 340 is connected to a middle portion of the pull belt 330. The collection net 340 is provided with a ball outlet hole 341. The cylindrical collection net 350 extends downward along an edge of the ball outlet hole 341. The collection net 340 is low in a middle portion and high at an edge, and the ball outlet hole 341 is arranged in the middle portion of the collection net 340. Through the arrangement of the above structure, when in use, the volleyball intercepted by the interception net 310 falls down to the collection net 340, rolls along a surface of the collection net 340, and finally passes through the ball outlet hole 341 and falls into the cylindrical collection net 350, thereby effectively storing the volleyball and facilitating the user to retrieve and use the volleyball. In addition, the middle portion of the collection net 340 is low and the edge of the collection net 340 is high, which makes the volleyball roll towards the ball outlet hole 341 in the middle portion of the collection net 340 under the action of gravity, thereby improving the efficiency of the volleyball entering the cylindrical collection net 350.

In this embodiment, the interception net component 300 also includes a front net 360 and two side nets 370. A lower edge of the front net 360 is connected to an edge of the collection net 340 and extends upward. A side edge of the front net 360 is connected to the pull belt 330. A lower edge of the side net 370 is connected to a side edge of the collection net 340 and extends upward. A side edge of the side net 370 is connected to the pull belt 330 and a side edge of the interception net 310. Through the arrangement of the above structure, the front net 360 can intercept the volleyball that rebounds after hitting the interception net 310, preventing the volleyball from falling directly along a front edge of the collection net 340, and the two side nets can prevent the volleyball from falling along two side edges of the collection net 340, improving the efficiency of the volleyball return and storage, so that the user does not need to pick up the ball around, thereby improving the training efficiency and user experience of using the volleyball training device.

In this embodiment, an upper edge of the interception net 310 is higher than an upper edge of the volleyball net component 200, and the upper edge of the volleyball net component 200 is higher than an upper edge of the front net 360. A ball intercepting space with a front side opening is formed between the front net 360, the two side nets 370, and the interception net 310. Through the arrangement of the above structure, the upper edge of the interception net 310 is higher than the upper edge of the volleyball net component 200, which can effectively intercept the volleyball passing the upper edge of the volleyball net component 200, and facilitate the interception and storage of the volleyball. The upper edge of the front net 360 is lower than the volleyball net component 200, which allows the volleyball to pass the upper edge of the volleyball net component 200, and also enables the volleyball that rebounds after hitting the interception net 310 to be intercepted. The ball intercepting space can effectively intercept and store the volleyball.

Figure 7:
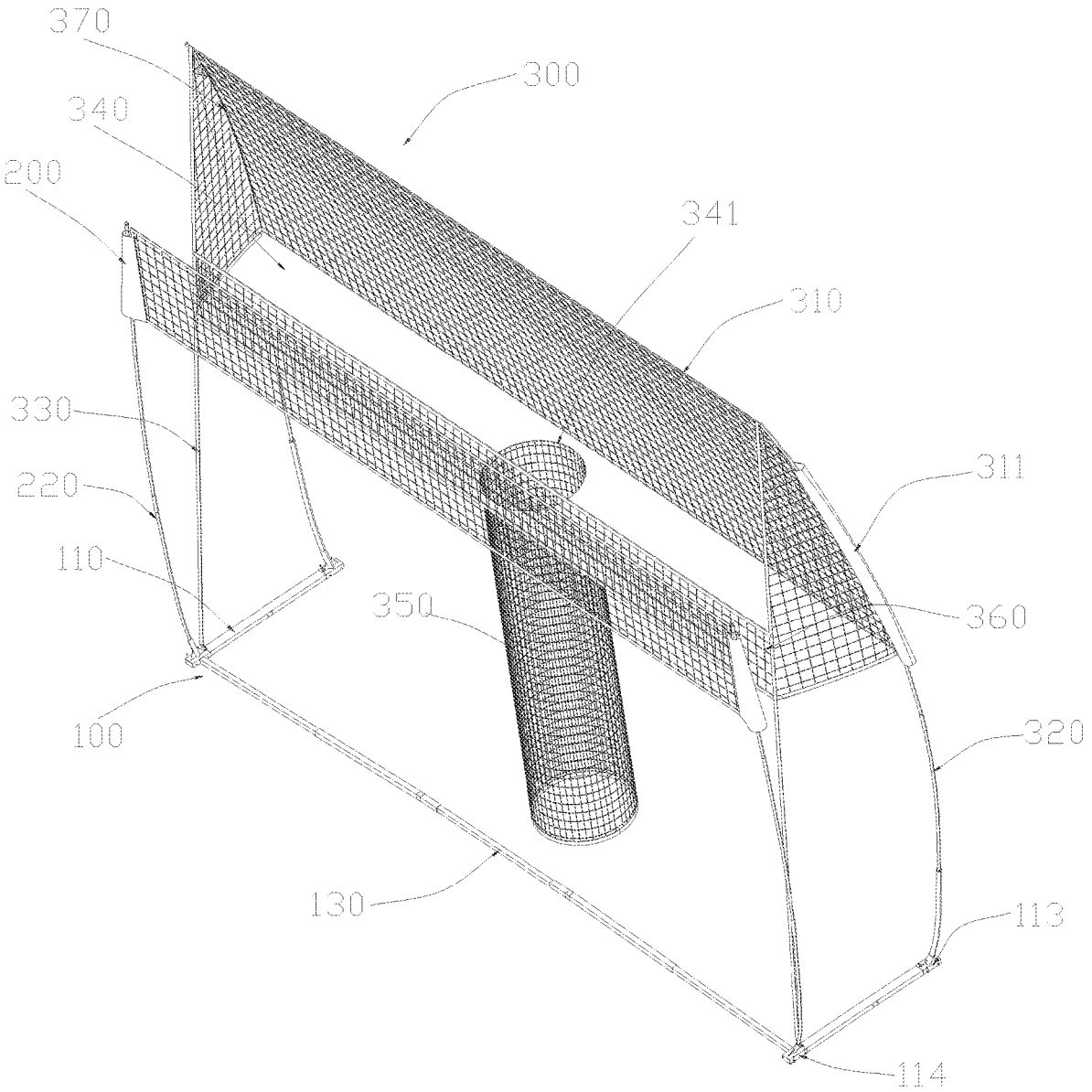
FIG. 7 is a schematic diagram of an overall structure from an angle of view in embodiment two of the present invention.
Figure 8:
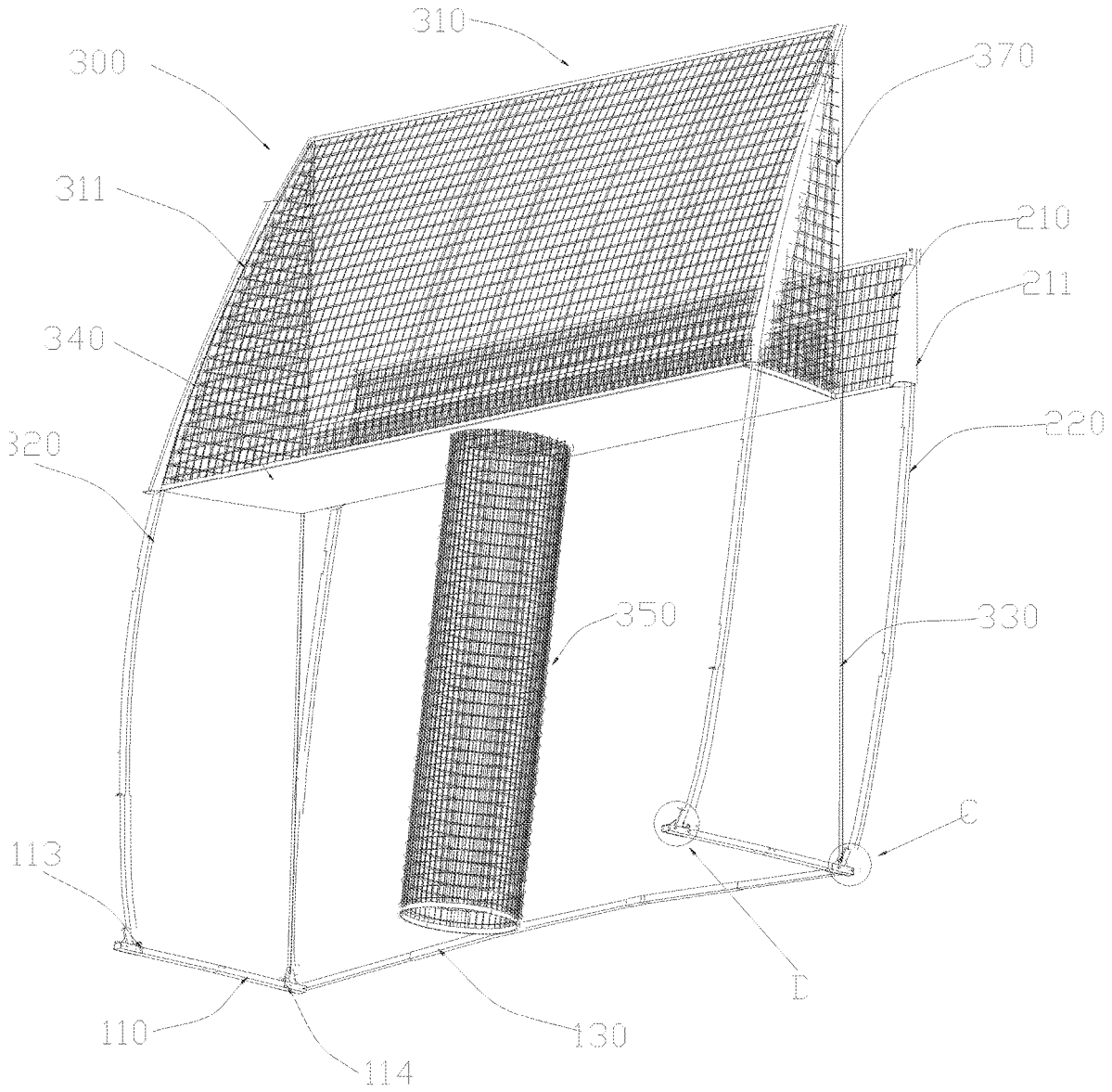
FIG. 8 is a schematic diagram of an overall structure from another angle of view in embodiment two of the present invention.
Figure 10:
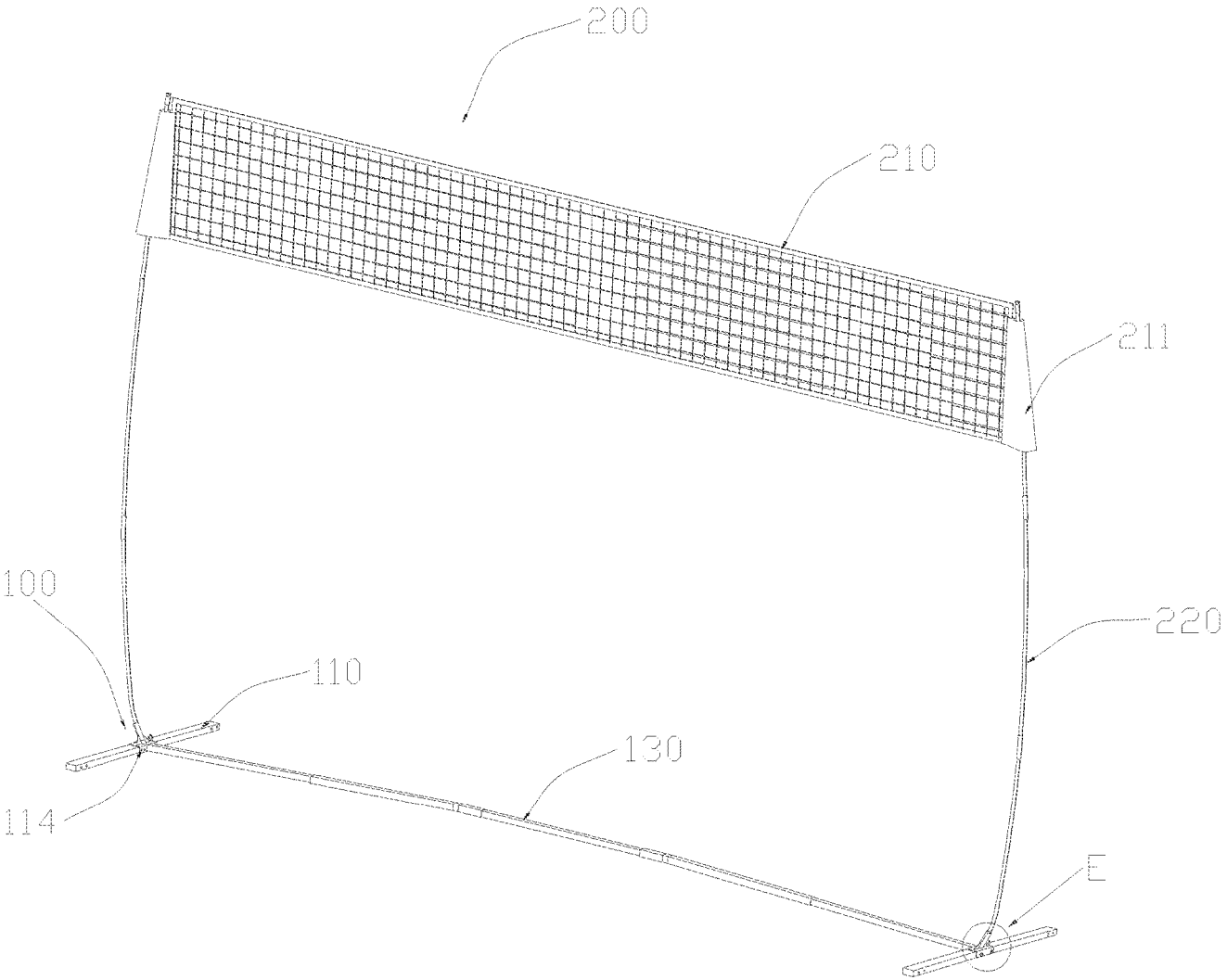
FIG. 10 is a structural diagram of embodiment two of the present invention when in a using state.

In this embodiment, the installation seat 110 includes a second connecting member 113 and a third connecting member 114. The second connecting member 113 is connected to a first end of the installation seat 110, and the third connecting member 114 is connected to a second end of the installation seat 110 or the middle portion of the installation seat 110. When in the using state, the second connecting member 113 is detached from the first end of the installation seat 110, the third connecting member 114 is connected to the middle portion of the installation seat 110, and the volleyball net component 200 is connected to the third connecting member 114. When in the training state, the second connecting member 113 is connected to the first end of the installation seat 110, and the third connecting member 114 is connected to the second end of the installation seat 110. The volleyball net component 200 is connected to the third connecting member 114, and the interception net component 300 is connected to the second connecting member 113. Referring to FIGS. 7-8, the third connecting member 114 is connected to a front end of the installation seat 110, the second connecting member 113 is connected to the rear end of the installation seat 110, the volleyball net component 200 is connected to the third connecting member 114, and the interception net component 300 is connected to the second connecting member 113. At this time, the product is in the training state, and the volleyball net component 200 and the interception net component 300 are arranged at intervals from front to back, making the center of gravity of the product more stable and the product not easy to tip over. Referring to FIG. 10, the second connecting member 113 is detached from the installation seat 110, the third connecting member 114 is connected to the middle portion of the installation seat 110, and the volleyball net component 200 is connected to the third connecting member 114. At this time, the product is in the using state. Both the front and rear sides of the volleyball net component 200 are partially protruding from the plane where the volleyball net component 200 is positioned, making the support of the product more stable and the product not easy to tip over when the volleyball net component 200 is impacted by the volleyball.

Figure 11:
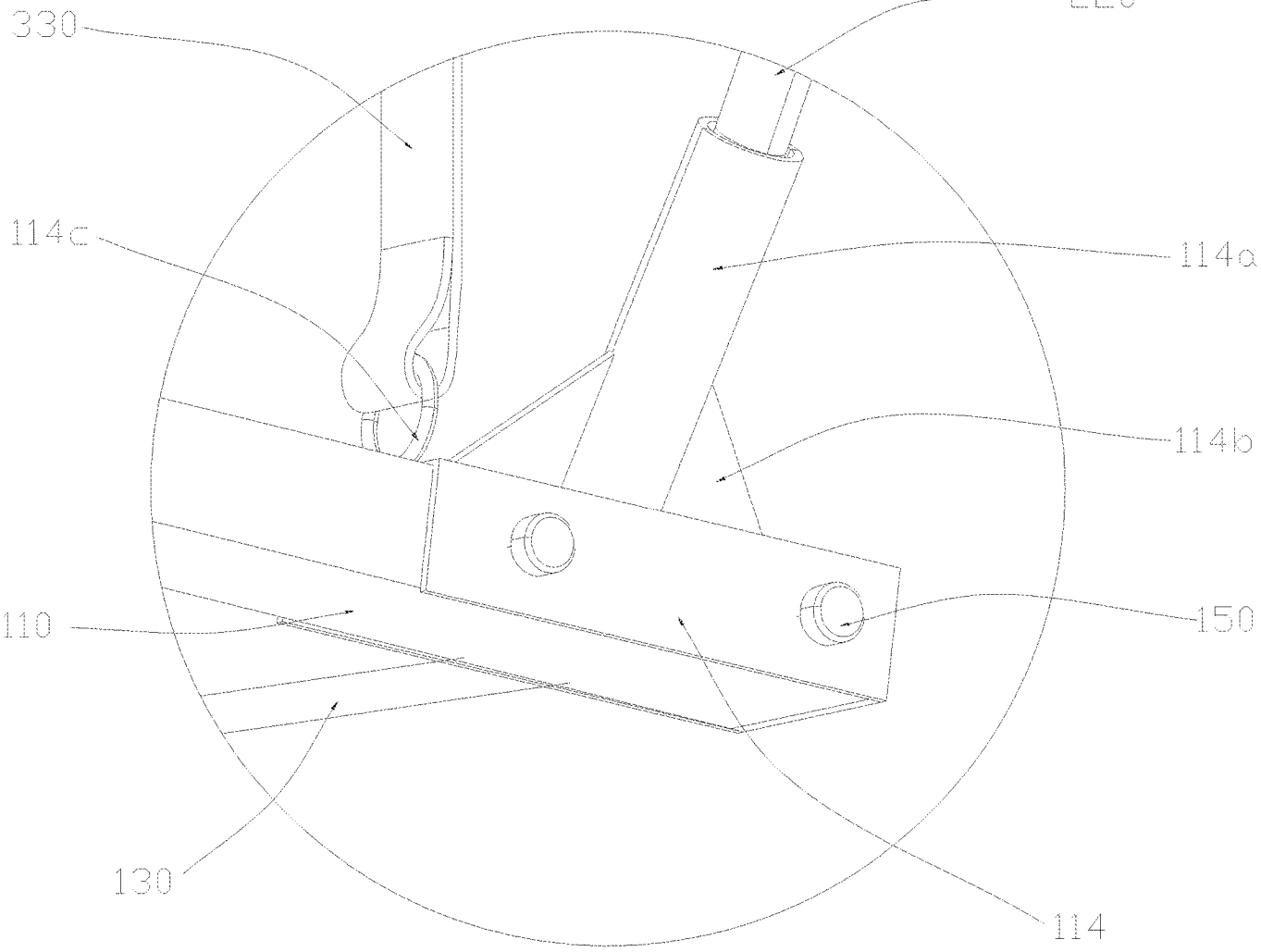
FIG. 11 is an enlarged view at circle C in FIG. 8.
Figure 12:
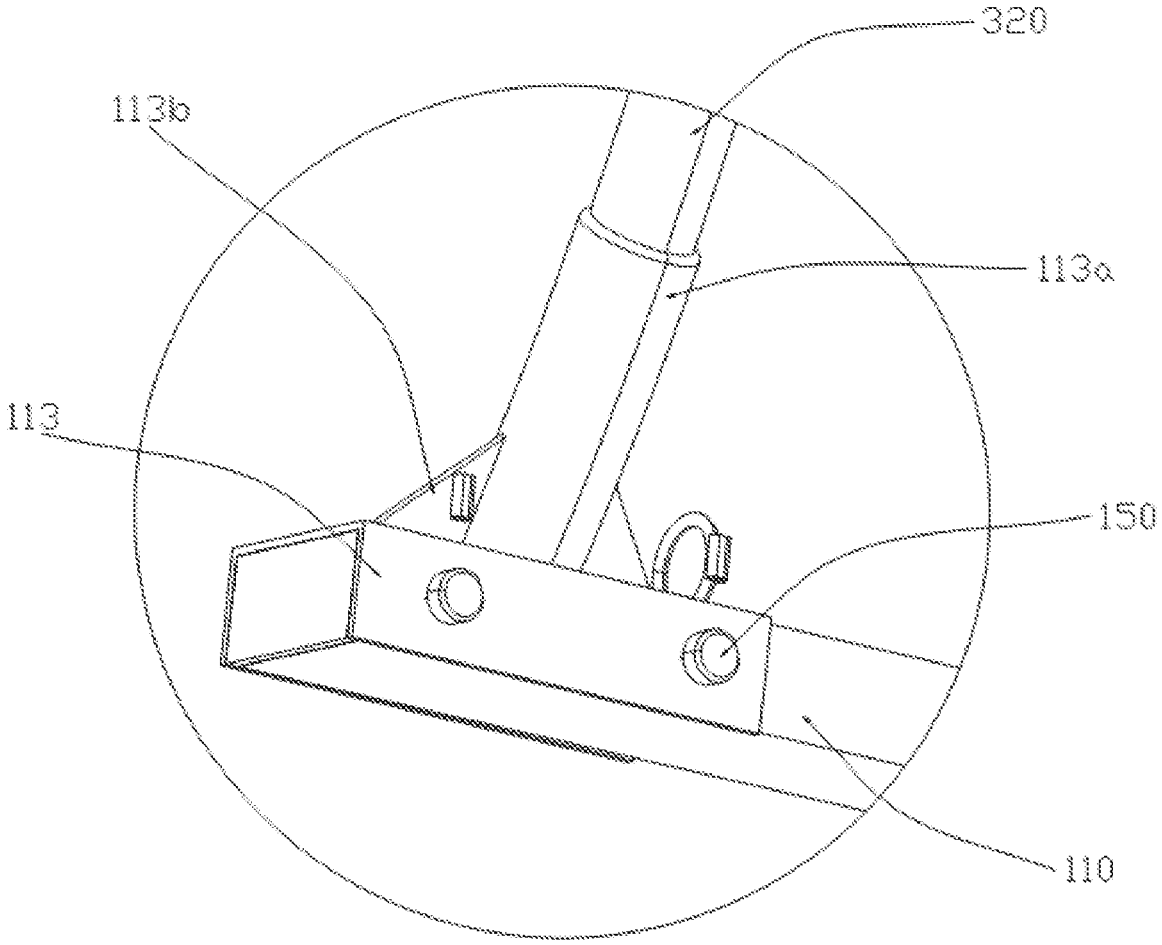
FIG. 12 is an enlarged view at circle D in FIG. 8.
Figure 13:
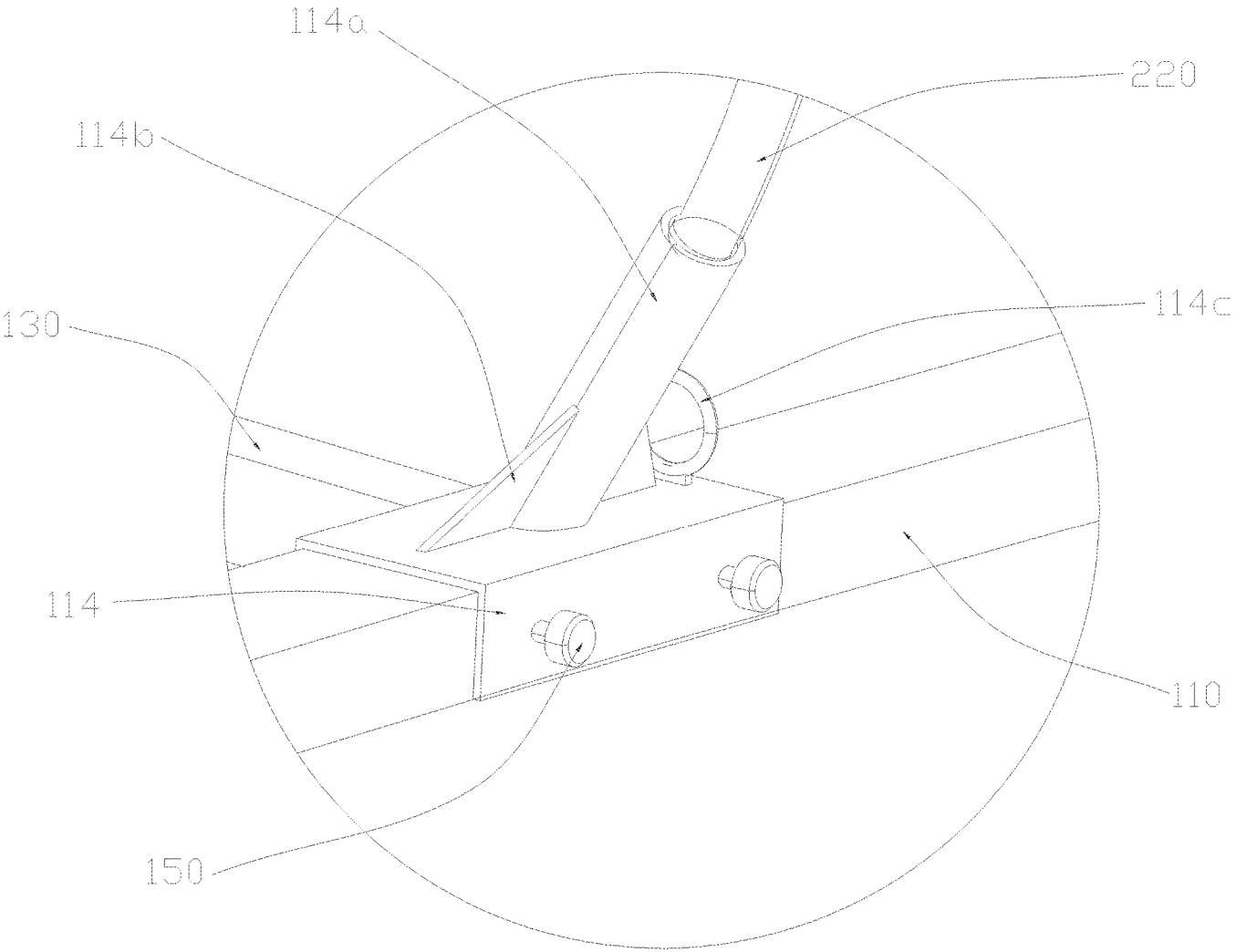
FIG. 13 is an enlarged view at circle E in FIG. 10.

In this embodiment, the second connecting member 113 is provided with a second insertion part **113*a* and a second reinforcement part 113***b* extending from both sides of the second insertion part 113*a*. The third connecting member 114 is provided with a third insertion part 114*a* and a third reinforcement part 114*b* extending from both sides of the third insertion part 114*a*. A lower end of the net supporting rod 220 is detachably inserted into the third insertion part 114*a*, and the lower end of the supporting rod 320 of interception net is detachably inserted into the second insertion part 113*a*. As shown in FIGS. 11-13, the second reinforcement part 113*b* can strengthen the connection strength between the second insertion part 113*a* and a main body of the second connecting member 113, and the third reinforcement part 114*b* can strengthen the connection strength between the third insertion part 114*a* and a main body of the third connecting member 114, so as to improve the strength and stability of the product. In addition, the lower end of the net supporting rod 220 is inserted in the third insertion part 114*a*, and the lower end of the supporting rod 320 of interception net is inserted in the second insertion part 113*a*, which is convenient for the user to assemble the product. Preferably, the second insertion part 113*a* and the third insertion part 114*a* are both inclined upwards and to the left and right sides relative to an upper surface of the installation seat 110. When the net supporting rod 220 is inserted into the third insertion part 114*a*, and the supporting rod 320 of interception net is inserted into the second insertion part 113*a*, the net supporting rod 220 and the supporting rod 320 of interception net bend in an arc shape, elastic restoring forces of the net supporting rod 220 and the supporting rod 320 of interception net drive the two sides of the net 210 and the two sides of the interception net 310 to move outward, and the net 210 and the interception net 310 are taut to avoid the sagging of a middle portion of the net 210 and a middle portion of the interception net 310, thereby improving the use effect of the product.

In this embodiment, the base 100 also includes a second connecting rod 130, and both ends of the second connecting rod 130 are respectively connected to two third connecting members 114. Referring to FIGS. 7-8 and FIG. 10, the two ends of the second connecting rod 130 are respectively connected to the two third connecting members 114, and the third connecting member 114 is connected to the installation seat 110, which can limit the distance between the middle potions of the two installation seats 110, thereby ensuring the strength and stability of the base 100. Preferably, the second connecting rod 130 is in the shape of an arch bridge with a high middle and two low sides, making the connection between the second connecting rod 130 and the two installation seats 110 more stable, and preventing the elastic restoring forces of the net supporting rod 220 and the supporting rod 320 of interception net from driving the installation seat 110 to rotate to ensure the stability of the overall structure of the product. Moreover, since the third connecting member 114 needs to be connected to the installation seat 110 in both the using state and the training state, the second connecting rod 130 is arranged between the two third connecting members 114 to improve the stability of the product. Preferably, the third connecting member 114 is slidable on the installation seat 110, and the third connecting member 114 can be fixedly connected to the installation seat 110 in different positions, which can facilitate the user to adjust the installation position of the third connecting member 114, and thus facilitate the user to freely choose the product form between the using state and the training state.

Figure 9:
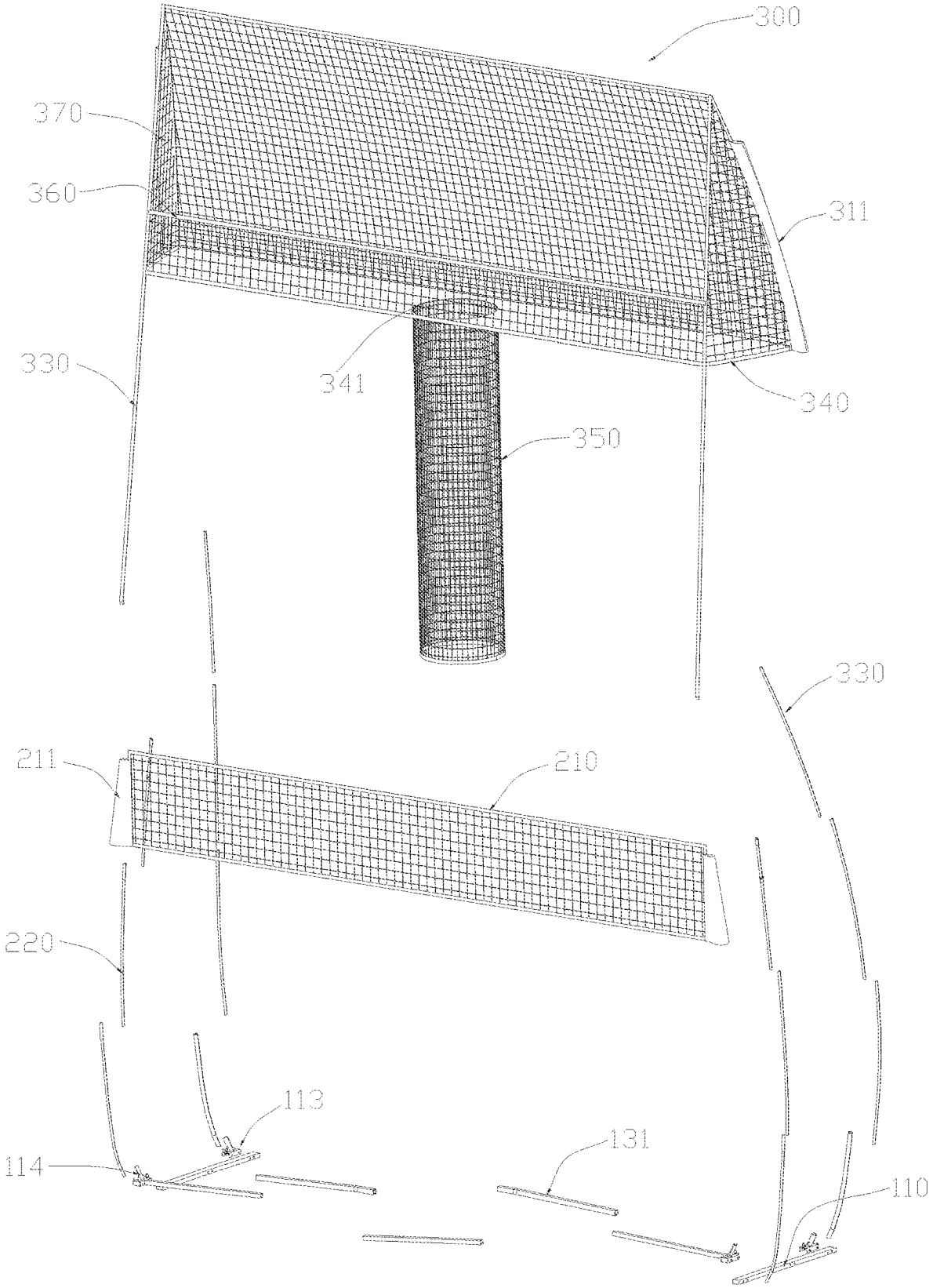
FIG. 9 is a schematic diagram of an exploded structure in embodiment two of the present invention.

In this embodiment, the second connecting rod 130 includes a plurality of second connecting rod units 131, and two adjacent second connecting rod units 131 are successively connected end to end. Referring to FIG. 9, the plurality of second connecting rod units 131 are successively connected end to end to form the second connecting rod 130, which can reduce a length of the product during the storage and transportation process, thus reducing a volume of the package and facilitating the user to carry.

In this embodiment, the volleyball training device also includes a second locking member 150, and the second locking member 150 fixes the third connecting member 114 and the fourth connecting member 112 to the installation seat 110. Referring to FIGS. 11-13, by using the second locking member 150, the third connecting member 114 and/or the fourth connecting member 112 can be fixed to the installation seat 110, so that the use is convenient, and the connection is fixed more stably to make the product stronger.

In this embodiment, the third connecting member 114 is provided with a second connecting ring 114*c*. When in the training state, the interception net component 300 is connected to the second connecting member 113, and the pull belt 330 is connected to the second connecting ring 114*c* on the third connecting member 114. Referring to FIGS. 7-8 and FIGS. 11-12, when in the training state, the third connecting member 114 is connected to the front portion of the installation seat 110, the second connecting member 113 is connected to the rear portion of the installation seat 110, the lower end of the supporting rod 320 of interception net is inserted into the second insertion part 113*a* on the second connecting member 113, and the pull belt 330 is connected to the second connecting ring 114*c* on the third connecting member 114, so that the interception net component 300 can be stably connected, and the upper portion of the interception net 310 and part of the supporting rod 320 of interception net can be bent forward to facilitate intercepting the volleyball.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A volleyball training device, having a training state and a using state, the volleyball training device comprising:

a base;

a volleyball net component, the volleyball net component being detachably connected to the base; and an interception net component, the interception net component being detachably connected to the base;

wherein when in the using state, the volleyball net component is connected to the base, and the interception net component is detached from the base; when in the training state, the volleyball net component is connected to the base, and the interception net component is connected to the base;

wherein the base comprises two installation seats, and both ends of the volleyball net component and both ends of the interception net component are respectively detachably connected to the two installation seats; when in the using state, the volleyball net component is connected to a middle portion of each of the installation seats, and the interception net component is detached from the installation seats; when in the training state, the volleyball net component is connected to a front portion of each of the installation seats, and the interception net component is connected to a rear portion of each of the installation seats.

2. The volleyball training device according to claim 1, wherein the volleyball net component comprises a net and a net supporting rod, the net is connected to the net supporting rod through a net connecting member, and a lower end of the net supporting rod is connected to one of the installation seats.

3. The volleyball training device according to claim 2, wherein the interception net component comprises an interception net, a supporting rod of interception net and a pull belt; both sides of the interception net are connected with the supporting rod of interception net through a connecting sleeve of interception net, and an upper end of the interception net is provided with the pull belt; a lower end of the supporting rod of interception net is connected to the rear portion of one of the installation seats, the pull belt is connected to the front portion of one of the installation seats, and the upper portion of the interception net is bent forward under the action of the pull belt.

4. The volleyball training device according to claim 3, wherein the interception net component also comprises a collection net and a cylindrical collection net, one side of the collection net is connected to a lower edge of the interception net, an opposite side of the collection net is connected to a middle portion of the pull belt, the collection net is provided with a ball outlet hole, and the cylindrical collection net extends downward along an edge of the ball outlet hole; the collection net is low in a middle portion and high at an edge, and the ball outlet hole is arranged in the middle portion of the collection net.

5. The volleyball training device according to claim 4, wherein the interception net component also comprises a front net and two side nets, a lower edge of the front net is connected to an edge of the collection net and extends upward, each side edge of the front net is connected to the pull belt, a lower edge of the side net is connected to a side edge of the collection net and extends upward, and each side edge of the side net is connected to the pull belt and a side edge of the interception net.

6. The volleyball training device according to claim 5, wherein an upper edge of the interception net is higher than an upper edge of the volleyball net component, the upper edge of the volleyball net component is higher than an upper edge of the front net, and a ball intercepting space with a front side opening is formed between the front net, the two side nets, and the interception net.

7. The volleyball training device according to claim 3, wherein each of the installation seats comprises two first connecting members, and the two first connecting members are detachably connected to both ends of the installation seat; when in the training state, the volleyball net component is connected to one of the first connecting members, and the interception net component is connected to another of the first connecting members.

8. The volleyball training device according to claim 7, wherein each installation seat is provided with a fourth connecting member; when in the using state, the volleyball net component is connected to the fourth connecting member, and the two first connecting members are detached from both ends of the installation seat.

9. The volleyball training device according to claim 3, wherein each installation seat comprises a second connecting member and a third connecting member, the second connecting member is connected to a first end of one of the installation seats, and the third connecting member is connected to a second end of one of the installation seats or the middle portion of one of the installation seats; when in the using state, the second connecting member is detached from the first end of one of the installation seats, the third connecting member is connected to the middle portion of one of the installation seats, and the volleyball net component is connected to the third connecting member; when in the training state, the second connecting member is connected to the first end of one of the installation seats, and the third connecting member is connected to the second end of one of the installation seats; the volleyball net component is connected to the third connecting member, and the interception net component is connected to the second connecting member.

10. The volleyball training device according to claim 8, wherein the first connecting member is provided with a first insertion part and a first reinforcement part extending from both sides of the first insertion part, the fourth connecting member is provided with a fourth insertion part and a fourth reinforcement part extending from both sides of the fourth insertion part, the lower end of the net supporting rod is detachably inserted into the fourth insertion part or one first insertion part, and the lower end of the supporting rod of interception net is detachably inserted into another first insertion part.

11. The volleyball training device according to claim 9, wherein the second connecting member is provided with a second insertion part and a second reinforcement part extending from both sides of the second insertion part, the third connecting member is provided with a third insertion part and a third reinforcement part extending from both sides of the third insertion part, a lower end of the net supporting rod is detachably inserted into the third insertion part, and the lower end of the supporting rod of interception net is detachably inserted into the second insertion part.

12. The volleyball training device according to claim 7, wherein the base also comprises a first connecting rod, and both ends of the first connecting rod are respectively connected to the middle portions of the two installation seats.

13. The volleyball training device according to claim 9, wherein the base also comprises a second connecting rod, and both ends of the second connecting rod are respectively connected to two third connecting members.

14. The volleyball training device according to claim 12, wherein the first connecting rod comprises a plurality of first connecting rod units, and two adjacent first connecting rod units are successively connected end to end.

15. The volleyball training device according to claim 13, wherein the second connecting rod comprises a plurality of second connecting rod units, and two adjacent second connecting rod units are successively connected end to end.

16. The volleyball training device according to claim 7, further comprising a first locking member, wherein the first locking member fixes the first connecting member to one of the installation seats.

17. The volleyball training device according to claim 9, further comprising a second locking member, wherein the second locking member fixes the third connecting member and the fourth connecting member to the installation seats.

18. The volleyball training device according to claim 7, wherein the first connecting member is provided with a first connecting ring; when in the training state, the interception net component is connected to one of the first connecting members, and the pull belt is connected to the first connecting ring on another of the first connecting members.

19. The volleyball training device according to claim 9, wherein the third connecting member is provided with a second connecting ring; when in the training state, the interception net component is connected to the second connecting member, and the pull belt is connected to the second connecting ring on the third connecting member.

* * * * *